United States Patent [19]

Kenny Sr.

[11] Patent Number: 4,697,958

[45] **Date of Patent: * Oct. 6, 1987**

[54] EMBEDMENT ANCHOR

[75] Inventor: Patrick M. Kenny Sr., Belle Chasse, La.

[73] Assignee: Ben-Jac, Inc., Belle Chasse, La.

[ * ] Notice: The portion of the term of this patent subsequent to Oct. 28, 2003 has been disclaimed.

[21] Appl. No.: 763,951

[22] Filed: Aug. 8, 1985

Related U.S. Application Data

[63] Continuation-in-part of Ser. No. 574,871, Jan. 30, 1984, Pat. No. 4,619,218.

[51] Int. Cl.[4] ..... E02D 5/74; B63B 21/28

[52] U.S. Cl. ..... 405/228; 114/295; 405/224

[58] Field of Search ..... 405/224, 228, 227; 114/294, 295; 175/6; 52/158; 89/1.1, 1.14; 403/2

[56] References Cited

U.S. PATENT DOCUMENTS

| | | | |
|---|---|---|---|
| 2,583,965 | 1/1952 | Page, Jr. et al. | 114/295 |
| 3,032,000 | 5/1962 | Feiler | 114/295 |
| 3,036,542 | 5/1962 | Robinson | 114/295 |
| 3,154,042 | 10/1964 | Thomason et al. | 114/295 |
| 3,170,433 | 2/1965 | Gardiner | 114/295 |
| 3,207,115 | 9/1965 | Anderson | 114/295 |
| 4,177,352 | 12/1979 | Dunbar et al. | 403/2 |

*Primary Examiner*—Dennis L. Taylor

*Attorney, Agent, or Firm*—Keaty & Keaty

[57] ABSTRACT

An improved, slow burning jet embedded anchor assembly for use in sedimentary strata and similarly non-consolidated or rocky ocean bottom surfaces is shown. The anchor comprises an inertially loaded reaction member above a substantially elongated anchor shaft, coaxially positioned around an elongated drive tube assembly. The anchor shaft has a number of open cross-section triangular sheet metal anchoring fins, providing substantially low resistance to penetration within the strata, but providing substantially high resistance to sideways displacement forces, as would be imposed through a standard anchor rod. The anchor is positioned by lowering the inertial reaction unit and embedded by the weight of the inertial reaction unit a distance into the surface layer of the subocean strata. An internal detonator control assures vertical embedment unless the anchor is vertically positioned. The anchor is remotely fired after initial embedment.

3 Claims, 6 Drawing Figures

EMBEDMENT ANCHOR

This is a continuation-in-part of U.S. Pat. No. 4,619,218 issued on Oct. 28, 1986, and disclosure of that application is incorporated by reference as fully as it appeared herein.

BACKGROUND OF THE INVENTION

1. Field of the Invention

The present invention relate to the embedment of anchoring or mooring devices on the surface of the sea or ocean floor. More particularly, the invention relates to an improved embedment of an anchor, using a slow burning powder that propels the anchor shaft downward into the sea or ocean floor.

2. Description of the Prior Art

The general purpose of this invention is to provide an improved deep penetrating embedment anchor for use in marine applications.

Embedment anchors are used to provide for secure holding and accurate positioning of buoyant vessels in the sea or ocean.

The present state of the art has been represented in, for example, U.S. Pat. No. 2,583,965 issued to Page, Jr., et al. in 1952, U.S. Pat. No. 3,032,000 issued to Feiler in 1962 and U.S. Pat. No. 3,170,433 issued to Gardiner in 1965.

Page, et al. disclose a pile driving apparatus adapted for driving piles beneath the surface of a body of water with the help of explosion force, which is directed downwardly against the piling by the inertia of a driving head and also by the inertia of a water column above it.

Feiler discloses an embedment anchor in which an explosive charge is used to drive the anchor into the ocean bottom. It also includes a propulsion means to embed the anchor in the bottom of a body of water, and has a firing mechanism which will only ignite the propellant charge upon an engagement of the anchor with the ocean bottom.

Gardiner discloses an embedment anchor, wherein an explosive charge is used to drive an anchor into the ocean bottom, with the explosive anchor having a recoverable and reuseable recall assembly. There are further provided means to separate the anchor components immediately following the major separation of the projectile assembly and the recall assembly so that most resistance is offered to the subsequent orienting of the projectile assembly.

All these patents suffer from one major disadvantage. They use explosion as a driving force for embedment of anchors. And the explosion itself occurs after the engagement with an ocean bottom which causes detonation in the explosive material.

SUMMARY OF THE INVENTION

The present invention overcomes shortcomings and disadvantages of the prior art in a simple and straightforward manner. The concept of propulsion of an anchor to be embedded into the sea bottom is utilized in the present invention. A one time driving force is used to achieve full penetration of the anchor into the strata. There is no necessity to have a contact with the sea bottom to initiate an explosion within the "gun barrel". In accordance with the present invention, the entire anchor assembly is lowered to ocean floor and generally penetrates the sea bed under the weight of the inertia weight box, which weighs at least four times as much as the anchor, although tests have shown that the ratio ten to one is even more preferable.

Additionally, the anchor embedded in accordance with the present invention is permanent and cannot be retrieved.

The anchor is embedded into the sea bed under the pressure created by gases burning within the "gun barrel" providing necessary propulsion of the anchor to be embedded.

The embedment of the anchor in accordance with the present invention does not require the use of divers which substantially reduces the cost of embedment operation. Additionally, the amount of anchor chain which is required for by conventional anchors is reduced to a minimum of 50%.

The inertia weight box assembly and the gun barrel assembly of the apparatus of the present invention are retrievable and can be reused for anchor embedment operations at other locations which allows to further cut the costs of the operations.

An improved slow burning jet embedded anchor assembly is shown having special utility for use for precision anchorages, such as are required in the oil drilling industry where an oil rig is moored at sea to a precise location for drilling purposes. The anchor is designed specifically for mooring within sedimentary strata, although it will function in most sea bottom structures not comprising consolidated rock.

The anchor of the instant invention is intended to provide an apparatus permitting both accurate positioning of the embedded anchor as well as providing a stronger and more resistant mooring or anchoring base than heretofore has been possible with explosively embedded anchors. It incorporates a substantially longer anchor spear than has been possible with the prior art. It couples this with embedding means to insure that the elongated anchor spear is embedded in a substantially vertical position deep in the strata so as to provide the maximum resistance to withdrawal from an anchor rode of proper scope. At the same time the cross-section triangular fins of the apparatus provide for high resistance to sideways displacement forces imposed by an anchor a rode. The resulting mooring is capable of securing large floating structures such as drill platforms in heavy storm seas. The overall resistance of the resulting anchoring or mooring structure is substantially greater tha that provided by the embedded anchors of the prior art.

It is thus an object of the present invention to provide for an embedment anchoring means capable of embedding an anchor with no explosion within the gun barrel, utilizing the pressure created by gases as a propellant force within the gun barrel.

It is a further object of the present invention to provide for an anchor assembly which gradually penetrates the sea bed prior to the anchor being permanently embedded in the sea bed.

It is still a further object of this invention to provide an embedded anchoring means capable of withstanding greater withdrawal forces than heretofore has been possible.

It is a further object of this invention to provide an embedded anchoring means capable of embedding a substantially larger anchor than heretofore has been possible.

It is a further object of this invention to provide an embedded anchoring means which insures that the embedded anchor is embedded in a substantially deeper vertical position, having thereby maximum resistance to withdrawal forces from an anchor a rode.

These and other objects and advantages of the instant invention will be more clear from the detailed description of the preferred embodiment which follows.

DETAILED DESCRIPTION OF THE PREFERRED EMBODIMENT

Figure 1:
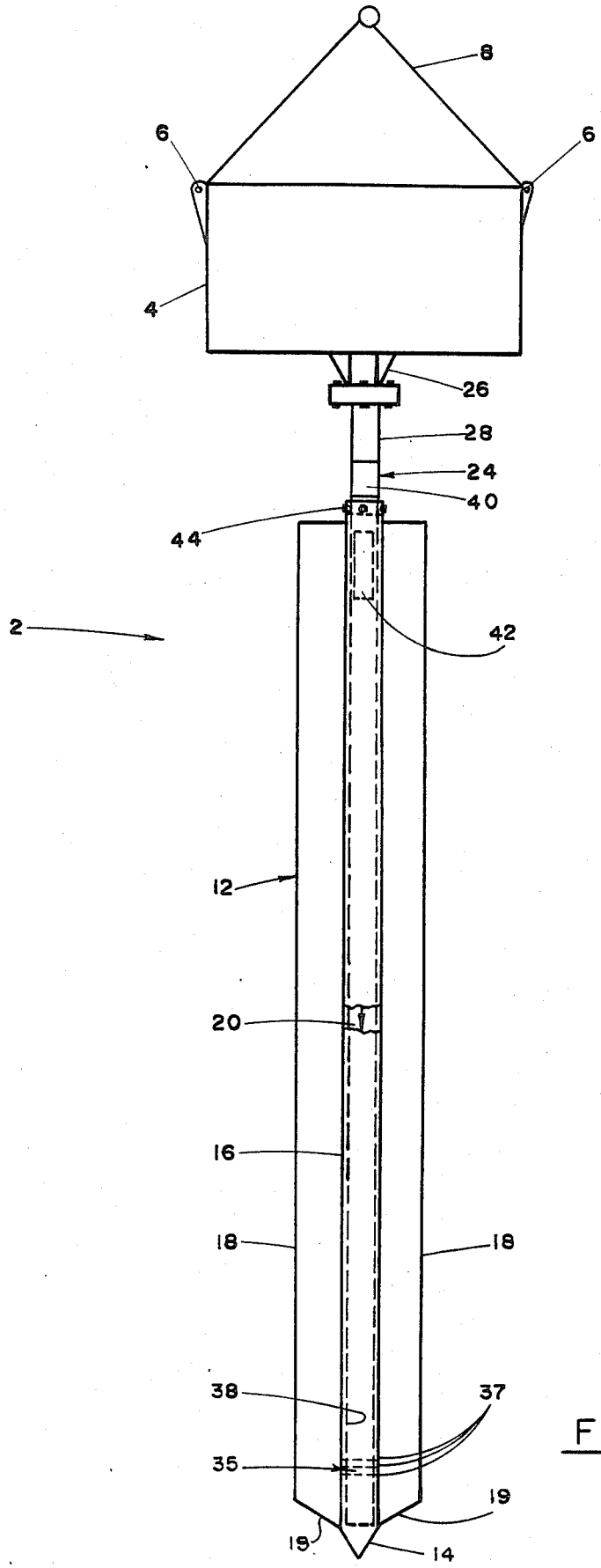
FIG. 1 is a side view of the overall embedment assembly in the unfired position.

FIG. 1 shows the overall slow burning jet anchor assembly 2. The slow burning jet assembly 2 is seen to comprise an essentially vertical assembly having at its top a drive weight 4 which comprises a substantially heavy structure. In the preferred embodiment, this is a structure comprising primarily a reinforced concrete slab having either a cylindrical or a rectangular structure. The weight of inertia weight box 4 in the preferred embodiment must be at least four times as much as the weight of the anchor to be embedded. The preferred embodiment of the invention will show this weight ratio as 5 to 1. At upper corners of the drive weight 4 are found a plurality of drive weight mooring points 6 to which is attached a drive weight suspension harness 8 permitting the entire slow burning jet anchor 2 to be raised, lowered, or otherwise manipulated by standard crane or lifting means, not shown, attached to the drive weight suspension harness 8.

Figure 4:
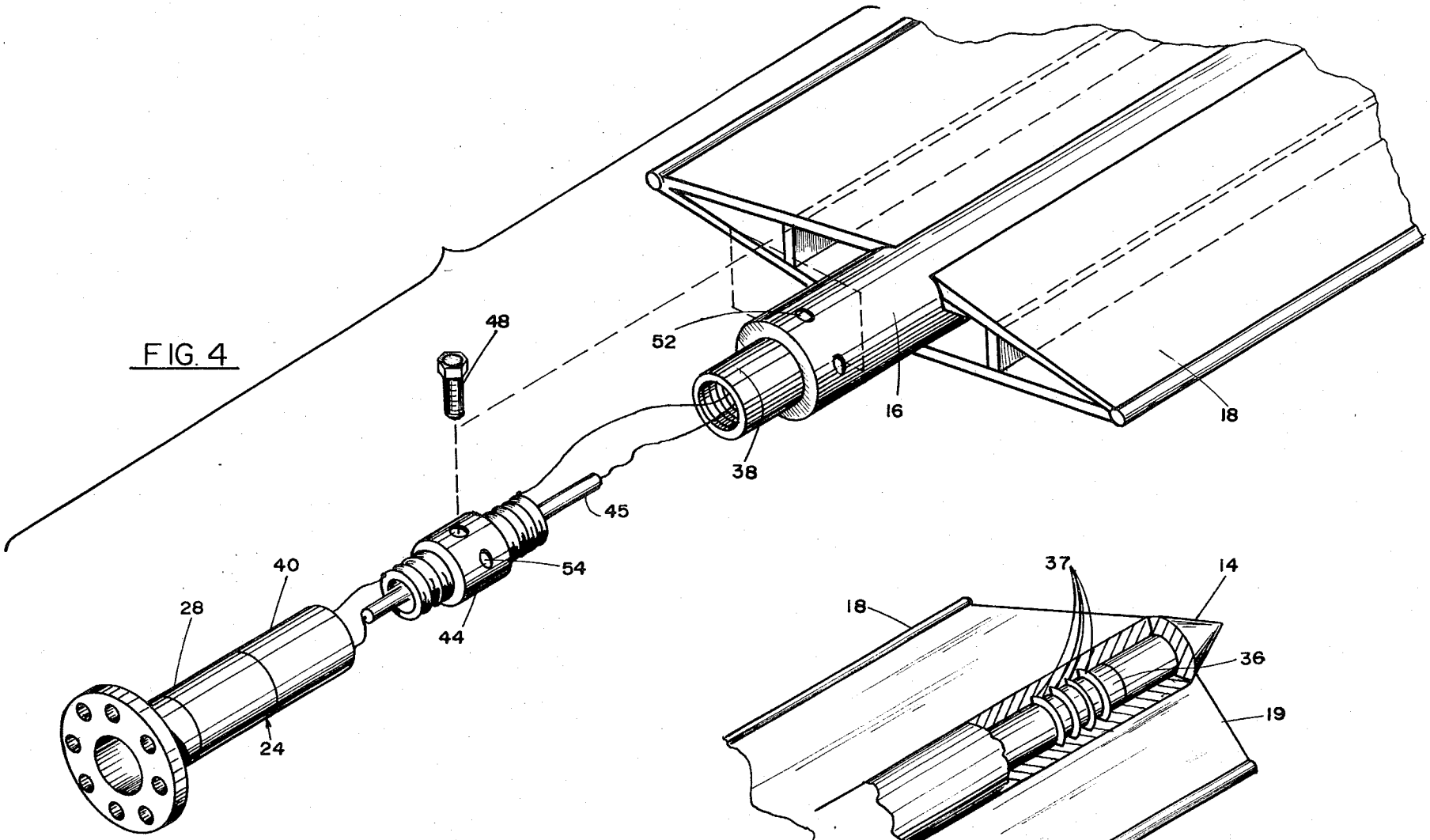
FIG. 4 is an exploded partial view showing detail of drive tube assembly interconnected to sleeve shaft body.
Figure 5:
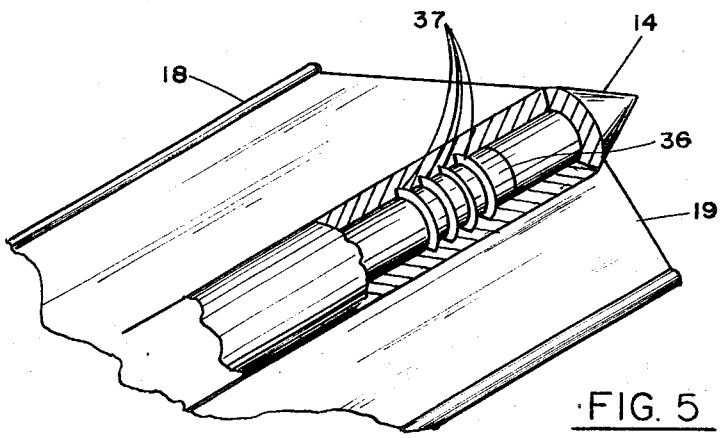
FIG. 5 is an elevational view of the lower part of sleeve shaft body with attached penetrator fins, with a cutaway section for clarity showing sealing means.
Figure 6:
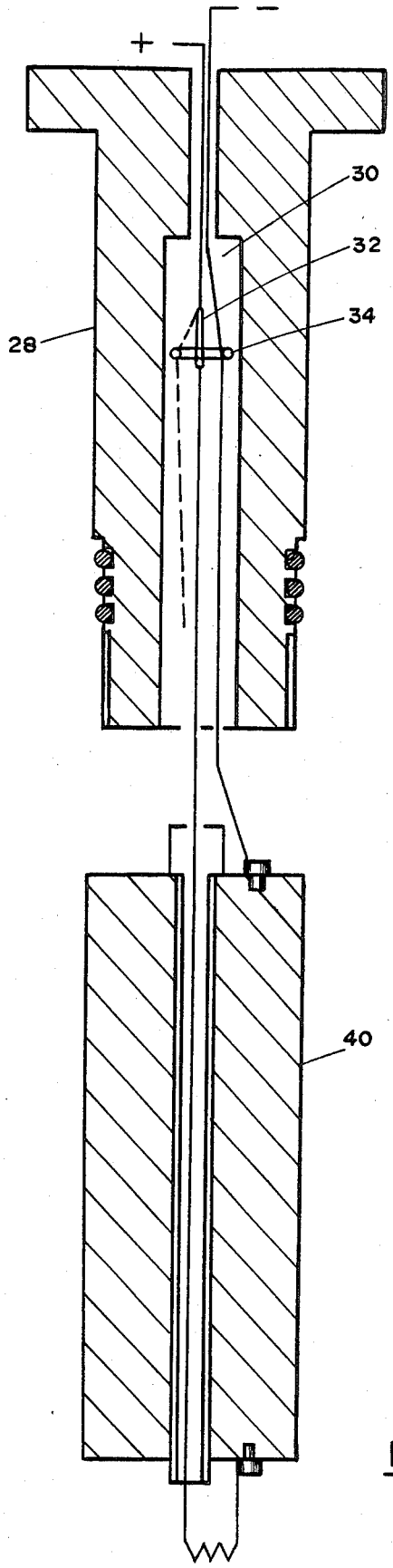
FIG. 6 is a cross-sectional view showing electrical circuit of the detonation means in accordance with the present invention.

Extending vertically down from the drive weight 4, centered therefrom, may be seen an assemblage comprising an anchor spear 12 of substantially elongated shape which is coaxially mounted upon a drive tube assembly 24 vertically extending downward from drive weight 4, connected thereto through a flange subassembly 28 and electrical head detonator assembly 40, securedly attached at its upper end to flange subassembly 28. Anchor spear 12, as mentioned, is coaxially installed about drive tube assembly 24, and is secured thereto by a shear bolt assembly 44, which as shown in FIG. 4 of the drawings, is provided with external threads on its both ends, so that its upper end is threadably connected to internal threads (not shown) of the electrical head detonator assemby 40, while its lower end is threadably connected to internal threads of a drive tube 38, which is coaxially mounted within a sleeve shaft body 16.

The drive tube 38 has a smaller outside diameter than an inside diameter of the sleeve shaft body 16, therefore allowing a limited axial sliding movement of the drive tube 38 within the sleeve body 16.

Shear bolts 48 are inserted into respective holes 52 made in shaft body 16 and are designed to be further inserted into holes 54 of shear bolt assembly 44, after holes 52 and 54 have been coaxially aligned.

This becomes possible after the lower external threads of the shear bolt assembly 44 are engaged with the internal threads of the drive tube 38 and the shear bolt assembly 44 is moved, along with a drive tube 38, inside the sleeve shaft body 16, until the holes 52 and 54 are coaxially aligned. Then the shear bolts 48 are inserted into the holes 52, to pass through the wall of the sleeve shaft body 16, then into holes 54 and through the wall of the shear bolt assembly 44.

Also seen in FIG. 4 is a detonation rod 45 electrically connected to an electrical detonator (not shown) which is part of the head detonator assemby 40.

It is apparent that the pressure within the "gun barrel" must achieve a predetermined value before the anchor is released. The detailed description of the operation of the apparatus of the present invention will be discussed in more details below.

Anchor spear 12, in turn, comprises an essentially elongated metal assembly. In the preferred embodiment of the slow burning jet anchors, spear 12 is in excess of eighteen feet long although lengths as short as six feet are acceptable. Anchor spear 12 terminates at a bottom deflection point 14, which in turn forms a closed end to an elongated sleeve shaft body 16 which sealingly encloses the drive tube assembly 24. Radially extending outward from the sleeve shaft 16 are a plurality of penetrator fins 18. In the preferred embodiment, penetrator fins 18 are of a hollow, triangular cross section formed of a mild steel sheet. Penetrator fins 18 further have an angled lower entry face 19 which is open to the interior hollow triangular shape of the penetrator fins 18. The penetrator fins 18 extend in a smoothly vertically attached manner for the length of the sleeve shaft body 16 from a point adjacent to the penetration point 14 vertically to a point adjacent to the top of the sleeve shaft body 16. At a point on the sleeve shaft body 16 adjacent to the mid-point of the shaft body 16, is found an anchor point 20 for connecting to an anchor rode 46.

Extending within the length of the sleeve shaft body 16 is the drive tube assembly 24. Drive tube assembly 24 extends from a weight base 26 embedded within weight 4, and extends downwards, connecting through a flange subassembly 28 to slow burning jet drive tube 38, all in a manner such that the overall drive tube assembly 24 is both centered and extends vertically downward when the drive weight 4 is suspended by the drive weight suspension harness 8 in a hanging condition.

Figure 2:
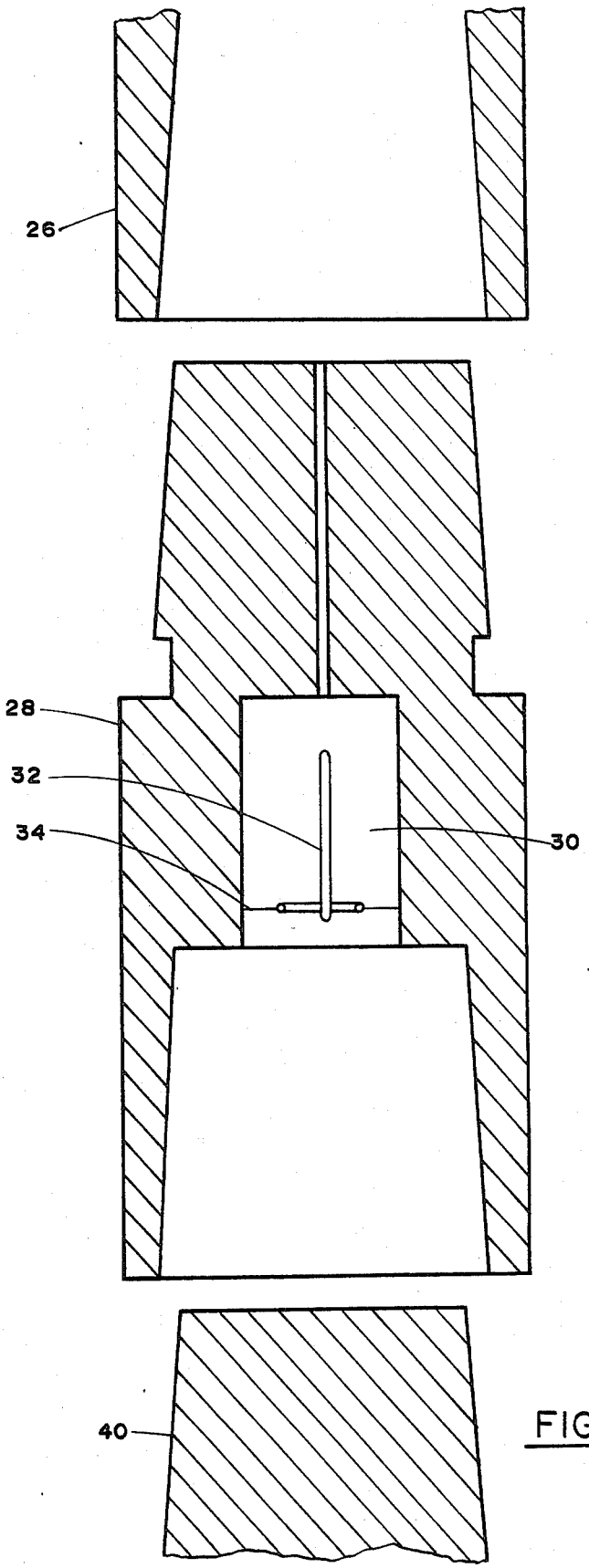
FIG. 2 is an exploded view of an embodiment with a vertical position sensor means for controlling firing.
Figure 3:
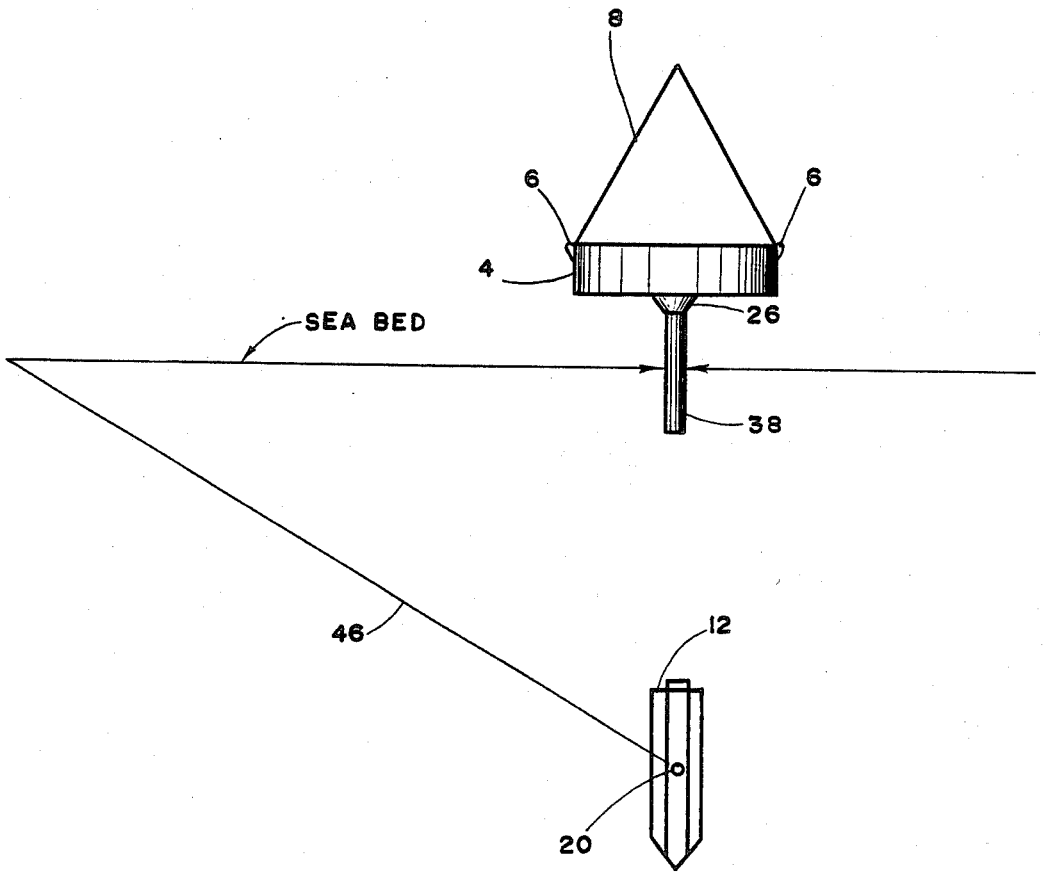
FIG. 3 is a side section view of the embedded anchor.

Flange subassembly 28 is shown in FIG. 2 to further contain vertical position sensing means 30. Vertical position sensing means 30 in a preferred embodiment comprises an electrically conductive pendulum 32, axially suspended, freely adapted for swinging, within electrical shorting ring 34. Flange subassembly 28 is sealingly connected to drive tube 38 such that pendulum 32 and shorting ring 34 are isolated from the underwater environment and remain substantially dry.

Drive tube 38 extends downward from flange subassembly 28 coaxially within sleeve shaft body 16 of the anchor spear 12. Within drive tube 38 is found an electrical head detonator assembly 40 adapted for electrical detonation of the slow burning jet powder 42. It is a particular part of this invention that the slow burning jet powder 42 disposed within the upper end of the drive tube 38 is a relatively low velocity jetting powder. It is important to note that there is no explosion within the drive tube 38. Jet powder 42 slowly burns creating the gases which are required to attain the necessary pressure to drive the anchor downwardly and embed it into the sea bed. In a preferred embodiment, jetting power 42 is Black Powder. The head detonator assembly 40 is an electrical detonator of standard underwater design. The head detonator assembly 40 is electrically connected in parallel with an electrical switch means formed by the pendulum 32 and the shorting ring 34 in a manner hereinafter explained. The head detonator assembly 40 is electrically connected in a manner well known to the art, not shown, axially through the drive tube 38 of flange subassembly 28, the weight bae 26 and the drive weight 4 and arising up connected adjacently to the drive weight suspension harness 8 to a surface detonation controller.

Annularly installed about the lower exterior end of the drive tube 38 sealingly contacting the drive tube 38 and the interior of the sleeve shaft body 16 is sealing means 35. Sealing means 35 comprises O-ring seals 37, adapted to form an essentially gas and water tight seal, at the lower conjunctive end of drive tube 38 and sleeve shaft body 16. Seal means 35 both secures slow burning jet powder 42 in a dry state underwater, and seals the jet powder gas within tube 38 and shaft 16 during airing.

In operation, the entire slow burning jet anchor 2 is lowered through the sea by means of a crane or the like connected to the drive weight suspension harness 8. The overall geometry of the drive weight suspension harness 8 and the substantial length and weight of the anchor spear 12 cause the anchor spear 12 to remain in an essentially vertical position as the anchor 2 is lowered.

The slow burning jet anchor 2 is lowered until the deflection point 14 contacts the sea bed floor. The combined effect of the weight of the drive weight 4 (which in the preferred embodiment weighs five times more than the anchor spear 12), the shape of the deflection point 14, and the angled, essentially open shape of the lower entry faces 19 of the penetrator fins 18 cause the anchor spear 12 to be driven by weight and impact, a substantial distance into the sea bed floor. It is found sufficient that there is at least three feet of penetration. It is important to note that the material from which anchor barrel, gun barrel and penetrator fine is made is adapted to soil conditions, foot pounds required and depth of penetration desired.

If the penetration has occurred in a substantially vertical direction, that is, if there has been no deflection of the anchor spear 12 as it penetrates the sea floor, then pendulum 32 will remain suspended axially within shorting ring 34, without making electrical contact therewith, and thereby will not cause the vertical position sensing means 30 to short out the electrical circuit to the head detonator assembly 40.

Upon determination that the anchor 2 has embedded itself partially within the sea floor, as would be apparent from a slacking of the cable attached to the drive weight suspension harness 8, the surface detonation control device means are activated. Provided that the vertical position sensing means 30 has not, in the manner of a safety switch, shorted out the electrical firing circuitry to the head detonator assembly 40, the head detonator assembly 40 is activated detonating the gas generation slow burning jet powder 42 within the drive tube 38. The gas generator slow burning jet powder 42 occupies only a top portion of the drive tube 38 adjacent to the head detonator assembly 40. It is important to repeat that there is no explosion incorporated in the operation of the present invention. The propellant burns creating the gases required to obtain the necessary pressure needed to drive the anchor into the sea bed. A controlled, relatively low velocity shock wave thereby builds up within drive tube 38 for driving downwards against anchor spear 12 and reacting upwards against drive weight 4. The substantial inertial effects of drive weight 4 cause it to resist the relatively lower impact velocities of the gas generator slow burning jet powder 42. The substantially flat top surface aspect of the drive weight 4 introduces a degree of hydrodynamic reaction against the forces exerted by the gas generator slow burning jet powder 42. It is to be noted that the lower velocity slow burning jet powder, coupled with the relatively longer period application of drive forces in comparison with prior art devices would render a pure hydrodynamic reaction means ineffective.

The initial force of the detonation as applied against the anchor spear 12 and in reaction against the drive tube assembly 24 shears the shear assembly 44, freeing the anchor spear 12. The sealing means 35 provides a continuing gas tight seal between the anchor spear 12 and the drive tube 38, causing the continued force of the gas generator slow burning jet powder's 42 detonation to apply against the anchor spear 12 during the entire time of the anchor spear 12 travel down the drive tube 38. In the preferred embodiment of the invention, anchor spear 12 overlaps the drive tube 38 for a distance in excess of 18 feet. As is recalled, the effects of the drive weight 4 have already embedded the anchor spear 12 a distance into the sea floor. The continued, relatively long period driving force of the slow burning jet powder 42 against the anchor spear 12 continues to drive the anchor spear 12 in a vertical direction until the anchor spear 12 is substantially embedded approximately one to one and one-half times its length below the sea bed level. The deflection point 14 acts throughout to deflect spear 12 if it should contact rocks or other obstacles, without slowing spear 12.

The anchor spear 12 thus is in a nearly vertical position, extending within the sea bed, for a continuous, essentially long distance established by the overall length of the anchor spear 12 and the amount of overlap of the anchor spear 12 and the drive tube 38. The anchor rode 46, as is well known in the art of anchoring, develops an essentially horizontal scope as it extends away from the anchor mooring point 20 on a midpoint of the anchor spear 12. Thus, forces exerted against the overall embedded anchor spear 12 are esssentially horizontal. The overall embedded depth of the anchor spear 12 and the resistance against sideways motion of the vertically extending penetrator fins 18, combine to produce a substantial lever arm against the horizontal forces of the anchor rode 46, thereby providing a substantially strong mooring point.

In practice, it has been found that a single anchor spear of 18 foot, inches in length embedded at a dept of 26 feet secured a barge of 7000 tons displacement during a storm of force 8 where there were winds in excess of 75 knots and waves in excess of 20 feet. The amount of the anchored chain which was required for conventional anchors is greatly reduced, by a minimum of 50%. The anchor embedded in accordance with the present invention is permanent and cannot be retrieved. The weight box and the gun barrel assembly are retrievable and can be reused for subsequent embedment operations.

It can thus be seen that the described invention is capable of producing an embedded anchor of substantially greater strength and resistance to anchoring forces then is heretofore been possible in the field of embedment anchors. It is a material part of this invention that the anchor spear is embedded in a substantially vertical direction so as to provide maximum resistance to the generally horizontal forces of the anchor rode 46. It is of equal importance that the anchor spear 12 is of a substantially greater vertical length than heretofore has been found within the sphere of embedment anchors. It is found that the combination of the substantially low velocity gas generation of slow burning jet powder 42 with the relatively extended drive time provided by the coaxially mating lengths of the drive tube 38 of the anchor spear 12, all as sealed by the sealing means 35, provides a capability of driving the anchor spear 12 through its entire length into the subsea floor strata. This is in distinction to the earlier high velocity anchors known to the art which have a limited penetration capability, and which therefore require various articulated displacement devices to resist withdrawing forces imposed by the anchor rode 46.

It can thus be seen that the anchor of the present invention encompasses a wider variety of equivalents than the specific preferred embodiment described above; the invention therefore includes those equivalents as claimed.

I claim:

1. An embedment anchor assembly for anchoring to a sea floor, comprising:

a. an inertia load drive member;

b. a substantially elongated drive tube assembly extending vertically downward from said inertia load drive member;

c. a substantially elongated anchor shaft means mounted coaxially around said drive tube assembly;

d. an anchor fin means attached to the anchor shaft means and adapted to provide a substantially low resistance to penetration within the sea floor and providing a substantially high resistance to sideways displacement forces;

e. a low velocity burning jet means positioned within the drive tube assembly;

f. an electrical detonation means for detonating the low velocity burning jet means mounted within the drive tube assembly;

g. vertical position sensing means adapted to prevent detonation of the low velocity burning jet means if the position of the anchor shaft means is away from vertical;

h. means for attaching an anchor rode means to the anchor shaft means; and i. a shear bolt assembly adapted to provide for releasable attachment of the anchor shaft means to the drive tube assembly adjacent their respective upper portions.

2. The apparatus of claim 1, further comprising:

sealing means positioned between the drive tube assembly and the anchor shaft means for providing an essentially gas and water tight seal between the drive tube assembly and the anchor shaft means.

3. The apparatus of claim 1, wherein the anchor fin means comprise:

a pair of open cross-section triangular sheet metal fins attached to the anchor shaft means in opposed relationship to each other.

* * * * *